US009664425B2

(12) United States Patent
Tsai

(10) Patent No.: US 9,664,425 B2
(45) Date of Patent: May 30, 2017

(54) HEAT PUMP WATER HEATER APPLIANCE AND A METHOD FOR OPERATING THE SAME

(71) Applicant: General Electric Company, Schenectady, NY (US)

(72) Inventor: Craig Iung-Pei Tsai, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 549 days.

(21) Appl. No.: 14/195,934

(22) Filed: Mar. 4, 2014

(65) Prior Publication Data

US 2015/0253049 A1 Sep. 10, 2015

(51) Int. Cl.

| | |
|---|---|
| ***F24H 4/04*** | (2006.01) |
| ***F25B 47/02*** | (2006.01) |
| ***F25B 49/02*** | (2006.01) |
| *F24D 19/10* | (2006.01) |

(52) U.S. Cl.

CPC ..... *F25B 47/022* (2013.01); *F24H 4/04* (2013.01); *F25B 47/02* (2013.01); *F25B 49/022* (2013.01); *F24D 19/1054* (2013.01); *F24F 2221/183* (2013.01); *F25B 2313/0315* (2013.01); *F25B 2347/023* (2013.01)

(58) Field of Classification Search

CPC .. F24D 17/0031; F24D 17/0047; F24D 17/02; F24D 19/1054; F24F 2221/183; F24H 4/04; F25B 47/02; F25B 47/022; F25B 2347/02; F25B 2347/021; F25B 2347/023

See application file for complete search history.

(56) References Cited

U.S. PATENT DOCUMENTS

| | | | | |
|---|---|---|---|---|
| 4,400,949 | A * | 8/1983 | Kinoshita | F25D 21/02 62/140 |
| 4,459,816 | A * | 7/1984 | Lung | F24D 17/02 62/183 |
| 5,623,834 | A * | 4/1997 | Bahel | F25B 49/005 62/131 |
| 6,715,304 | B1 * | 4/2004 | Wycoff | F25D 21/002 62/155 |
| 2011/0100041 | A1 | 5/2011 | Crawford et al. | |
| 2013/0118188 | A1 * | 5/2013 | McKie | F24F 11/0086 62/81 |

FOREIGN PATENT DOCUMENTS

| | | |
|---|---|---|
| CN | 202328800 | 7/2012 |
| DE | 102006024871 | 11/2007 |

* cited by examiner

*Primary Examiner* — Jonathan Bradford
(74) *Attorney, Agent, or Firm* — Dority & Manning, P.A.

(57) ABSTRACT

A method for defrosting an evaporator of a water heater appliance is provided. The method includes initiating a defrost cycle of the water heater appliance, deactivating a compressor of the water heater appliance during the defrost cycle of the water heater appliance, and operating a fan of the water heater appliance during the defrost cycle of the water heater appliance. A related water heater appliance is also provided.

15 Claims, 3 Drawing Sheets

HEAT PUMP WATER HEATER APPLIANCE AND A METHOD FOR OPERATING THE SAME

FIELD OF THE INVENTION

The present subject matter relates generally to water heater appliances, such as heat pump water heater appliances, and methods for operating the same.

BACKGROUND OF THE INVENTION

Heat pump water heaters are gaining broader acceptance as a more economic and ecologically-friendly alternative to electric water heaters. Heat pump water heaters include a sealed system for heating water to a set temperature. The sealed system generally includes a condenser configured in a heat exchange relationship with a water storage tank within the water heater appliance. For example, the condenser may be wrapped around the water storage tank in a series of coils. During operation of the sealed system, a refrigerant exits an evaporator as a superheated vapor and/or high quality vapor mixture. Upon exiting the evaporator, the refrigerant enters a compressor where the pressure and temperature increase and the refrigerant becomes a superheated vapor. The superheated vapor from the compressor enters the condenser, wherein the superheated vapor transfers energy to the water within the water storage tank and returns to a saturated liquid and/or high quality liquid vapor mixture.

During operation of the sealed system, water vapor can condense or desublimate on the evaporator and form a frost buildup over time. The frost buildup can negatively affect performance of the sealed system. To remove the frost buildup from the evaporator, heat pump water heater appliances are generally configured for performing a defrost cycle periodically. As an example, certain heat pump water heater appliances include heating elements mounted to the evaporator that are activated during the defrost cycle to melt the frost buildup. Operating heating elements during the defrost cycle can be energy intensive and negatively affect an efficiency of such heat pump water heater appliances. As another example, certain heat pump water heater appliances include a reversing valve for directing heated refrigerant from the compressor to the evaporator in order to melt the frost buildup. Melting the frost buildup in such a manner requires operating the compressor and can also require an additional, expensive valve.

Accordingly, a method for defrosting an evaporator of a heat pump water heater appliance efficiently and/or economically would be useful. In particular, a method for defrosting an evaporator of a heat pump water heater appliance without requiring heating elements on evaporator or operating a compressor of the water heater appliance would be useful.

BRIEF DESCRIPTION OF THE INVENTION

The present subject matter provides a method for defrosting an evaporator of a water heater appliance. The method includes initiating a defrost cycle of the water heater appliance, deactivating a compressor of the water heater appliance during the defrost cycle of the water heater appliance, and operating a fan of the water heater appliance during the defrost cycle of the water heater appliance. A related water heater appliance is also provided. Additional aspects and advantages of the invention will be set forth in part in the following description, or may be apparent from the description, or may be learned through practice of the invention.

In a first exemplary embodiment, a method for defrosting an evaporator of a water heater appliance is provided. The method includes initiating a defrost cycle of the water heater appliance, deactivating a compressor of the water heater appliance during the defrost cycle of the water heater appliance, and operating a fan of the water heater appliance during the defrost cycle of the water heater appliance. The fan of the water heater appliance draws a flow of air across the evaporator of the water heater appliance during the step of operating.

In a second exemplary embodiment, a water heater appliance is provided. The water heater appliance includes a tank that defines an interior volume. A sealed system includes a compressor, a condenser and an evaporator. The compressor is operable to compress refrigerant. The condenser is in fluid communication with the compressor such that refrigerant from the compressor is received by the condenser. The condenser is also thermally coupled to the tank in order to heat water within the interior volume of the tank with energy from the refrigerant. A fan is positioned adjacent the evaporator of the sealed system. The fan is configured for selectively directing a flow of air across the evaporator of the sealed system. A controller is in operative communication with the compressor and the fan. The controller is configured for initiating a defrost cycle, deactivating the compressor of the sealed system during the defrost cycle, and operating the fan during the defrost cycle in order to direct the flow of air across the evaporator of the sealed system.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
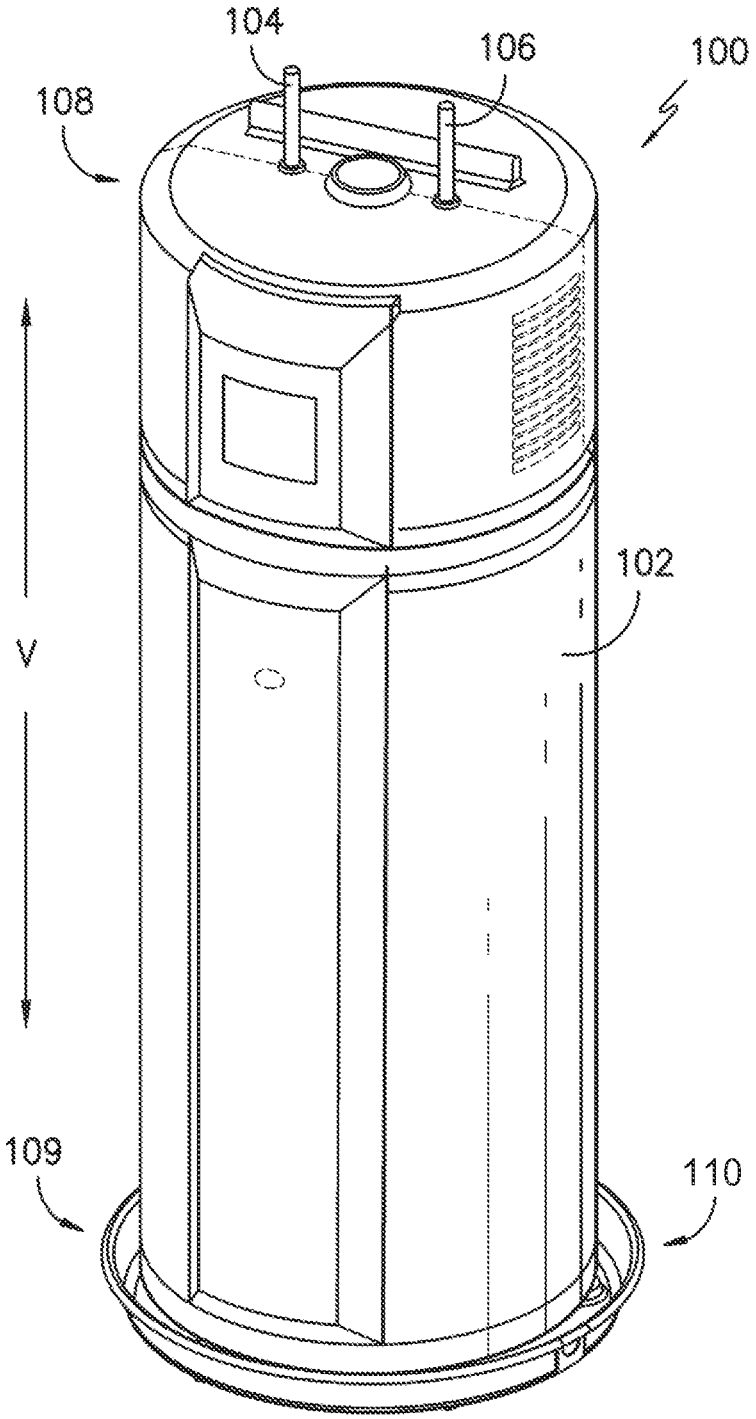
FIG. 1 provides a perspective view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
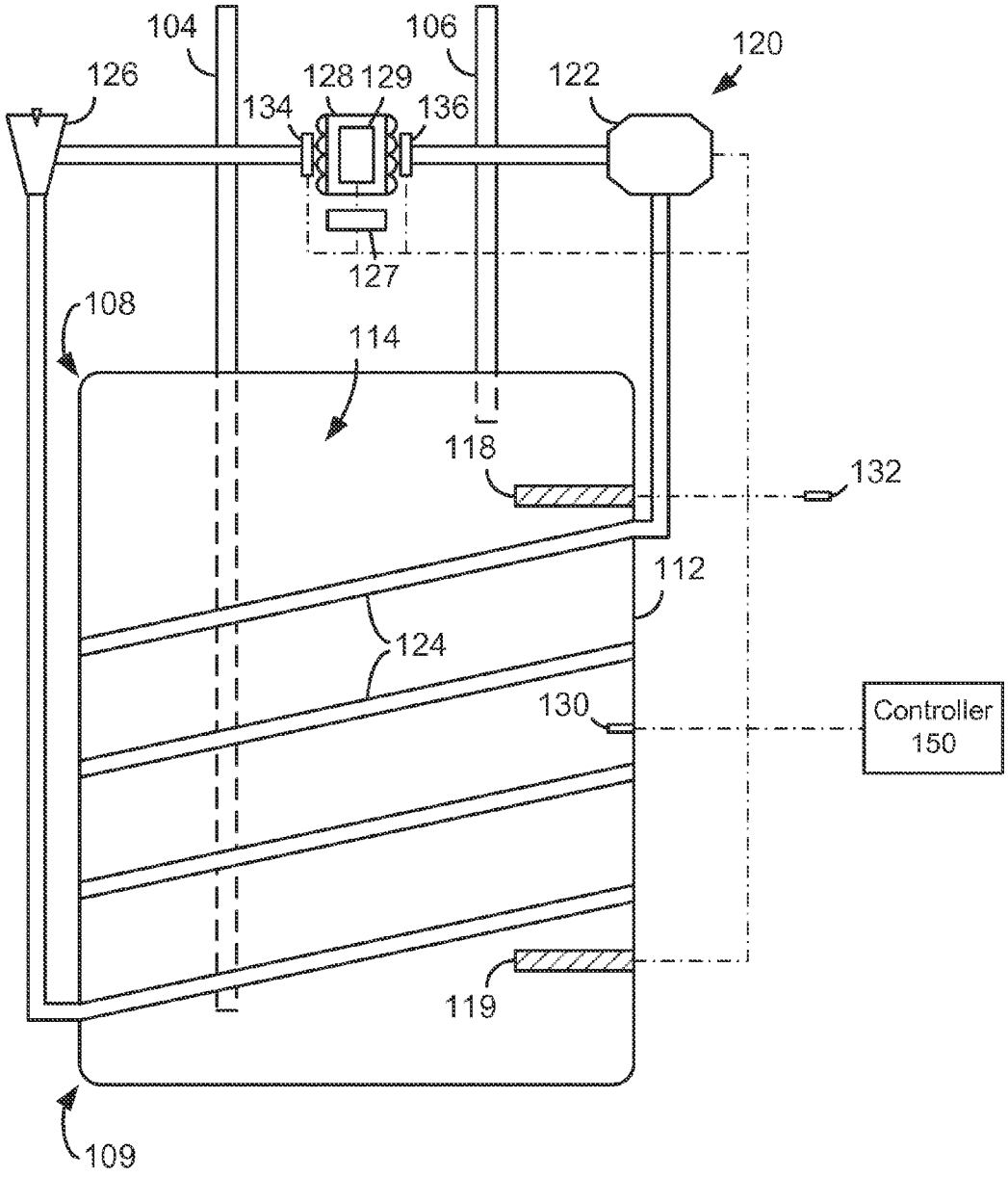
FIG. 2 provides a schematic view of certain components of the exemplary water heater appliance of FIG. 1.

FIG. 1 provides a perspective view of a water heater appliance 100 according to an exemplary embodiment of the present subject matter. FIG. 2 provides a schematic view of certain components of water heater appliance 100. Water heater appliance 100 includes a casing 102. A tank 112 (FIG. 2) is mounted within casing 102. Tank 112 defines an interior volume 114 for heating water therein.

Water heater appliance 100 also includes a cold water conduit 104 and a hot water conduit 106 that are both in fluid communication with tank 112 within casing 102. As an example, cold water from a water source, e.g., a municipal water supply or a well, enters water heater appliance 100 through cold water conduit 104. From cold water conduit 104, such cold water enters interior volume 114 of tank 112 wherein the water is heated to generate heated water. Such heated water exits water heater appliance 100 at hot water conduit 106 and, e.g., is supplied to a bath, shower, sink, or any other suitable feature.

As may be seen in FIG. 1, water heater appliance 100 extends between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100.

A drain pan 110 is positioned at bottom portion 109 of water heater appliance 100 such that water heater appliance 100 sits on drain pan 110. Drain pan 110 sits beneath water heater appliance 100 along the vertical direction V, e.g., to collect water that leaks from water heater appliance 100 or water that condenses on an evaporator 128 of water heater appliance 100. It should be understood that water heater appliance 100 is provided by way of example only and that the present subject matter may be used with any suitable water heater appliance.

Turning now to FIG. 2, water heater appliance 100 includes an upper heating element 118 and a lower heating element 119 and a sealed system 120 for heating water within interior volume 114 of tank 112. Thus, water heater appliance 100 is commonly referred to as a "heat pump water heater appliance." Upper and lower heating elements 118 and 119 can be any suitable heating elements. For example, upper heating element 118 and/or lower heating element 119 may be an electric resistance element, a microwave element, an induction element, or any other suitable heating element or combination thereof. Lower heating element 119 may also be a gas burner.

Sealed system 120 includes a compressor 122, a condenser 124, a throttling device 126 and an evaporator 128. Condenser 124 is thermally coupled or assembled in a heat exchange relationship with tank 112 in order to heat water within interior volume 114 of tank 112 during operation of sealed system 120. In particular, condenser 124 may be a conduit coiled around and mounted to tank 112. During operation of sealed system 120, refrigerant exits evaporator 128 as a fluid in the form of a superheated vapor and/or high quality vapor mixture. Upon exiting evaporator 128, the refrigerant enters compressor 122 wherein the pressure and temperature of the refrigerant are increased such that the refrigerant becomes a superheated vapor. The superheated vapor from compressor 122 enters condenser 124 wherein it transfers energy to the water within tank 112 and condenses into a saturated liquid and/or high quality liquid vapor mixture. This high quality/saturated liquid vapor mixture exits condenser 124 and travels through throttling device 126 that is configured for regulating a flow rate of refrigerant therethrough. Upon exiting throttling device 126, the pressure and temperature of the refrigerant drop at which time the refrigerant enters evaporator 128 and the cycle repeats itself. In certain exemplary embodiments, throttling device 126 may be an electronic expansion valve (EEV).

Water heater appliance 100 also includes a tank temperature sensor 130. Tank temperature sensor 130 is configured for measuring a temperature of water within interior volume 114 of tank 112. Tank temperature sensor 130 can be positioned at any suitable location within water heater appliance 100. For example, tank temperature sensor 130 may be positioned within interior volume 114 of tank 112 or may be mounted to tank 112 outside of interior volume 114 of tank 112. When mounted to tank 112 outside of interior volume 114 of tank 112, tank temperature sensor 130 can be configured for indirectly measuring the temperature of water within interior volume 114 of tank 112. For example, tank temperature sensor 130 can measure the temperature of tank 112 and correlate the temperature of tank 112 to the temperature of water within interior volume 114 of tank 112. Tank temperature sensor 130 can be any suitable temperature sensor. For example, tank temperature sensor 130 may be a thermocouple or a thermistor.

Water heater appliance 100 further includes a controller 150 that is configured for regulating operation of water heater appliance 100. Controller 150 is in, e.g., operative, communication with upper and lower heating elements 118 and 119, compressor 122 and tank temperature sensor 130. Thus, controller 150 may selectively activate upper and lower heating elements 118 and 119 and/or compressor 122 in order to heat water within interior volume 114 of tank 112.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may operate upper heating element 118, lower heating element 119 and/or compressor 122 in order to heat water within interior volume 114 of tank 112. As an example, a user may select or establish a set-point temperature for water within interior volume 114 of tank 112, or the set-point temperature for water within interior volume 114 of tank 112 may be a default value. Based upon the set-point temperature for water within interior volume 114 of tank 112, controller 150 may selectively activate upper heating element 118, lower heating element 119 and/or compressor 122 in order to heat water within interior volume 114 of tank 112 to the set-point temperature for water within interior volume 114 of tank 112. The set-point temperature for water within interior volume 114 of tank 112 can be any suitable temperature. For example, the set-point temperature for water within interior volume 114 of tank 112 may be between about one hundred degrees Fahrenheit and about one hundred and eighty-degrees Fahrenheit.

Water heater appliance 100 also includes an air handler or fan 127. Fan 127 is positioned adjacent evaporator 128 of sealed system 120. In particular, fan 127 is positioned and oriented directing a flow of air across evaporator 128 of sealed system 120 during operation of fan 127. Controller 150 is in operative communication with fan 127 such that controller 150 may selectively operate fan 127 in order to direct the flow of air across evaporator 128 with fan 127.

An evaporator heating element 129 is also positioned at or on evaporator 128 of sealed system 120. In particular, evaporator heating element 129 may be mounted or coupled to evaporator 128 such that evaporator heating element 129 heats evaporator 128 during operation of evaporator heating element 129. Controller 150 is in operative communication with evaporator heating element 129 such that controller 150 may selectively operate evaporator heating element 129 in order to heat evaporator 128 with evaporator heating element 129. Evaporator heating element 129 may be any suitable heating element 129. For example, evaporator heating element 129 may be an electric resistance heating element.

Water heater appliance 100 also includes an ambient temperature sensor 132, an inlet temperature sensor 134 and an outlet temperature sensor 136. Ambient temperature sensor 132, inlet temperature sensor 134 and outlet temperature sensor 136 may be any suitable temperature sensors. For example, ambient temperature sensor 132, inlet temperature sensor 134 and outlet temperature sensor 136 may be thermocouples, thermistors, combinations thereof, etc.

Ambient temperature sensor 132 is positioned and configured for measuring an ambient temperature, $t_a$. Thus, controller 150 may receive a signal from ambient temperature sensor 132 corresponding to the ambient temperature $t_a$ about water heater appliance 100. Inlet temperature sensor 134 is positioned adjacent an inlet of evaporator 128. For example, inlet temperature sensor 134 may be mounted to evaporator 128 at or adjacent the inlet of evaporator 128 or to a refrigerant conduit directing refrigerant into the inlet of evaporator 128. Inlet temperature sensor 134 is positioned and configured for measuring a refrigerant inlet temperature, of evaporator 128. Thus, controller 150 may receive a signal from inlet temperature sensor 134 corresponding to the temperature of refrigerant entering evaporator 128 at the inlet of evaporator 128. Outlet temperature sensor 136 is positioned adjacent an outlet of evaporator 128. For example, outlet temperature sensor 136 may be mounted to evaporator 128 at or adjacent the outlet of evaporator 128 or to a refrigerant conduit directing refrigerant out of the outlet of evaporator 128. Outlet temperature sensor 136 is positioned and configured for measuring a refrigerant outlet temperature, $t_o$, of evaporator 128. Thus, controller 150 may receive a signal from outlet temperature sensor 136 corresponding to the temperature of refrigerant exiting evaporator 128 at the outlet of evaporator 128.

Figure 3:
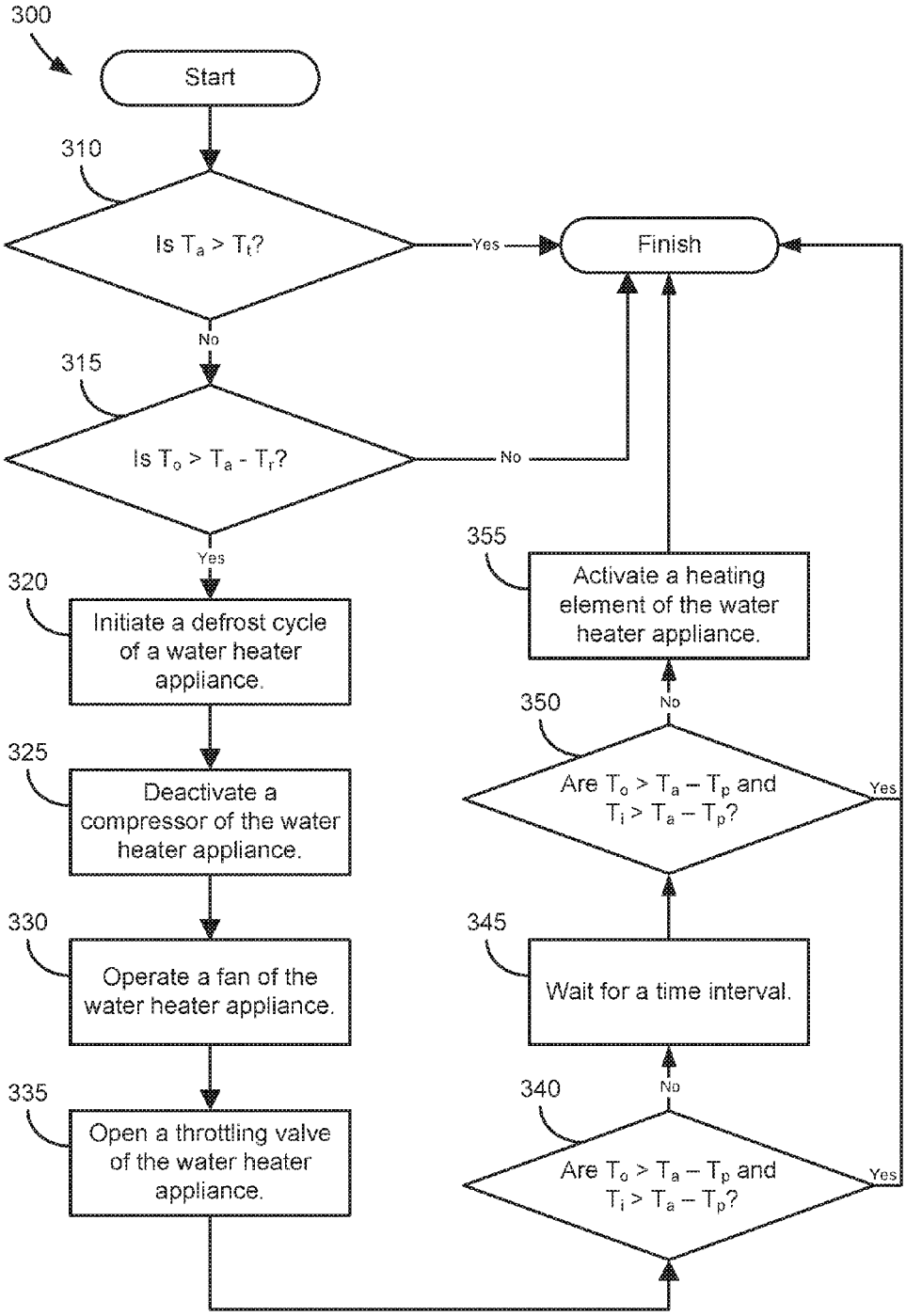
FIG. 3 illustrates a method for operating a water heater appliance according to an exemplary embodiment of the present subject matter.

FIG. 3 illustrates a method 300 for operating a water heater appliance during a defrosting operation according to an exemplary embodiment of the present subject matter. Method 300 can be used to operate any suitable water heater appliance. For example, method 300 may be used to operate water heater appliance 100 (FIG. 1). Controller 150 may be programmed or configured to implement method 300. Utilizing method 300, water heater appliance 100 can be operated efficiently and/or economically, e.g., during the defrosting operation of water heater appliance 100.

Prior to initiating a defrost cycle of water heater appliance 100. Method 300 includes various steps for establishing that conditions are such that evaporator 128 may frost over and/or that the defrost cycle is necessary. Such steps can assist with avoiding unnecessary defrost cycles.

At step 310, the ambient temperature $t_a$ about water heater appliance 100 is compared to a threshold temperature, $t_t$. If the ambient temperature $t_a$ about water heater appliance 100 is less than the threshold temperature $t_t$ at step 310, conditions may be such that frost buildup on evaporator 128 may negatively affect operation of evaporator 128 and/or water heater appliance 100. As an example, controller 150 may receive a signal from ambient temperature sensor 132 at step 310 to establish the ambient temperature $t_a$. Controller 150 may then compare the ambient temperature $t_a$ to the threshold temperature $t_t$ at step 310. The threshold temperature may be any suitable temperature. For example, the threshold temperature $t_t$ may be about forty-five degrees Fahrenheit. Thus, if the ambient temperature $t_a$ is less than forty-five degrees Fahrenheit at step 310, controller 150 establishes that a defrost cycle may be necessary. Conversely, if the ambient temperature $t_a$ is greater than forty-five degrees Fahrenheit at step 310, controller 150 establishes that a defrost cycle is not necessary.

At step 315, it is determined whether a difference between the ambient temperature $t_a$ and a reference temperature, $t_r$, is less than the refrigerant outlet temperature $t_o$ (or the refrigerant inlet temperature $t_i$ or both in alternative exemplary embodiments). If the difference between the ambient temperature $t_a$ and the reference temperature $t_r$ is less than the refrigerant outlet temperature $t_o$ at step 315, it can be determined that a defrost cycle is necessary and/or needed. As an example, controller 150 may receive a signal from outlet temperature sensor 136 at step 315 to establish or gauge the refrigerant outlet temperature $t_o$. Controller 150 may then determine whether the difference between the ambient temperature $t_a$ and the reference temperature $t_r$ is less than the refrigerant outlet temperature $t_o$ at step 315. Thus, if the difference between the ambient temperature $t_a$ and the reference temperature $t_r$ is less than the refrigerant outlet temperature $t_o$ at step 315, controller 150 establishes that evaporator 128 is frosted over and a defrost cycle is necessary. Conversely, if the difference between the ambient temperature $t_a$ and the reference temperature $t_r$ is not less than the refrigerant outlet temperature $t_o$ at step 315, controller 150 establishes that evaporator 128 is not frosted over and a defrost cycle is not necessary.

The reference temperature $t_r$ may be any suitable temperature. For example, the reference temperature $t_r$ may be about fourteen degrees Fahrenheit. It should be understood that the reference temperature $t_r$ may also vary or change, e.g., depending upon the ambient temperature $t_a$ and/or the set-point temperature for water within interior volume 114 of tank 112.

At step 320, a defrost cycle of water heater appliance 100 is initiated, e.g., if the difference between the ambient temperature $t_a$ and the reference temperature $t_r$ is less than the refrigerant outlet temperature $t_o$ at step 315. During the defrost cycle, compressor 122 of sealed system 120 is deactivated at step 325. In addition, fan 127 of water heater appliance 100 is operated during the defrost cycle at step 330. Thus, compressor 122 of sealed system 120 is deactivated and fan 127 of water heater appliance 100 is operated during at least a portion of the defrost cycle such that fan 127 is operating while compressor 122 is deactivated. Thus, steps 325 and 330 may be simultaneously performed during at least a portion of (e.g., substantially all of) the defrost cycle of water heater appliance 100.

During step 330, fan 127 draws a flow of air across evaporator 128. The flow of air across evaporator 128 during step 330 can assist with drawing refrigerant from condenser 124 of sealed system 120 to evaporator 128. The flow of air across evaporator 128 during step 330 can assist with increasing a partial pressure differential and/or density differential between refrigerant within condenser 124 and refrigerant within evaporator 128 in order to draw refrigerant from condenser 124 to evaporator 128. Thus, refrigerant from condenser 124 flows to evaporator 128 during steps 325 and 330.

Refrigerant within condenser 124 may have any suitable temperature during steps 325 and 330. For example, the temperature of refrigerant within condenser 124 may be greater than ninety degrees Fahrenheit, greater than one hundred degrees Fahrenheit, or greater than one hundred and twenty degrees Fahrenheit at steps 325 and 330. Heated refrigerant from condenser 124 can assist with defrosting evaporator 128. In particular, as will be understood by those skilled in the art, the refrigerant from condenser 124 can transfer heat from water in tank 112 to evaporator 128 in order to defrost evaporator 128 during the defrost cycle. In such a manner, method 300 can defrost evaporator 128 during the defrost cycle without utilizing evaporator heating element 129 and/or without operating compressor 122 to actively pump refrigerant from condenser 124 to evaporator 128.

Operating fan 127 at step 330 can also assist with convective heat transfer between ambient atmosphere and water on evaporator 128. Heat transfer ambient atmosphere and water on evaporator 128 can assist with defrosting evaporator 128. In addition, the flow of air across evaporator 128 during step 330 can also assist with urging water away from evaporator 128. Thus, the flow of air from fan 127 during step 330 can direct water off evaporator 128 and further assist with defrosting evaporator 128.

At step 335, throttling device 126 of sealed system 120 is opened. In particular, throttling device 126 may be adjusted to a fully open position at step 335. Step 335 may be performed after steps 325 and 330. For example, throttling device 126 may be opened more than about three minutes and less than about ten minutes after step 325 is started or initiated. By opening throttling device 126 at step 335, residual heated refrigerant within condenser 124 may be permitted to flow through throttling device 126 to evaporator 128. Thus, opening throttling device 126 at step 335 can assist with defrosting evaporator 128 during the defrost cycle without utilizing evaporator heating element 129 and/or without operating compressor 122 to actively pump refrigerant from condenser 124 to evaporator 128.

Method 300 also includes steps for determining when to terminate the defrost cycle and/or whether the defrost cycle was effective. To permit suitable refrigerant migration from condenser 124 to evaporator 128 during steps 320, 325 and/or 330, the defrost cycle may be performed for at least ten minutes after step 325 is started or initiated.

At step 340, it is determined whether a difference between the ambient temperature $t_a$ and a predetermined temperature, $t_p$, is less than the refrigerant outlet temperature $t_o$ and whether a difference between the ambient temperature $t_a$ and the predetermined temperature $t_p$ is less than the refrigerant inlet temperature $t_i$. If the difference is less than both the refrigerant outlet temperature $t_o$ and the refrigerant inlet temperature $t_i$ at step 340, it can be determined that a defrost cycle is complete and the evaporator 128 has been suitably defrosted. Thus, if the difference between the ambient temperature $t_a$ and the predetermined temperature $t_p$ is less than both the refrigerant inlet temperature $t_i$ and the refrigerant outlet temperature $t_o$ at step 340, controller 150 establishes that evaporator 128 is defrosted and the defrost cycle is complete. Conversely, if the difference between the ambient temperature $t_a$ and the predetermined temperature $t_p$ is not less than both the refrigerant inlet temperature $t_i$ and the refrigerant outlet temperature $t_o$ at step 340, controller 150 establishes that evaporator 128 is still frosted over and the defrost cycle is not complete.

The predetermined temperature $t_p$ may be any suitable temperature. For example, the predetermined temperature $t_p$ may be about two and one-half degrees Fahrenheit. It should be understood that the predetermined temperature $t_p$ may also vary or change, e.g., depending upon the ambient temperature $t_a$ and/or the set-point temperature for water within interior volume 114 of tank 112.

At step 345, controller 150 waits for a period of time. At step 350, controller 150 again determines whether the difference between the ambient temperature $t_a$ and the predetermined temperature $t_p$ is less than both the refrigerant inlet temperature $t_i$ and the refrigerant outlet temperature $t_o$. Steps 345 and 350 may be repeated periodically, e.g., every minute, for about ten minutes. If the difference between the ambient temperature $t_a$ and the predetermined temperature $t_p$ is again not less than both the refrigerant inlet temperature $t_i$ and the refrigerant outlet temperature $t_o$ at step 350, controller 150 activates evaporator heating element 129 at step 355 to defrost evaporator 128. Thus, if the passive defrost steps of method 300 fail to suitably defrost evaporator 128, controller 150 activates evaporator heating element 129 at step 355 to defrost evaporator 128. In such a manner, method 300 includes additional steps for insuring that evaporator 128 is suitably defrosted during method 300.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for defrosting an evaporator of a water heater appliance, comprising:

establishing, by use of a controller in communication with an ambient temperature sensor and an outlet temperature sensor positioned adjacent an outlet of the evaporator, that the evaporator of the water heater appliance is frosted over by:

measuring an ambient temperature, $t_a$, at the water heater appliance;

comparing the ambient temperature $t_a$ to a threshold temperature, $t_t$;

gauging a refrigerant outlet temperature, $t_o$, of the evaporator; and determining whether a difference between the ambient temperature $t_a$ and a reference temperature, $t_r$, is less than the refrigerant outlet temperature $t_o$, the reference temperature $t_r$ being adjustable based on the ambient temperature $t_a$;

initiating a defrost cycle of the water heater appliance;

deactivating a compressor of the water heater appliance during the defrost cycle of the water heater appliance; and operating a fan of the water heater appliance during the defrost cycle of the water heater appliance, the fan of the water heater appliance drawing a flow of air across the evaporator of the water heater appliance during said step of operating.

2. The method of claim 1, wherein the threshold temperature $t_t$ is about forty-five degrees Fahrenheit and the reference temperature $t_r$ is about fourteen degrees Fahrenheit.

3. The method of claim 1, wherein refrigerant from a condenser of the water heater appliance flows to the evaporator of the water heater appliance during said step of operating.

4. The method of claim 3, wherein the refrigerant from the condenser of the water heater appliance has a temperature greater than about ninety degrees Fahrenheit.

5. The method of claim 1, further comprising opening a throttling valve of the water heater appliance after said step of deactivating.

6. The method of claim 5, wherein said step of opening is performed more than about three minutes and less than about ten minutes after said step of deactivating.

7. The method of claim 1, further comprising terminating the defrost cycle of the water heater appliance.

8. The method of claim 7, wherein said step of terminating comprises determining whether a refrigerant outlet temperature, $t_o$, of the evaporator is greater than a difference between an ambient temperature, $t_a$, at the water heater appliance and a predetermined temperature, $t_p$; and establishing whether a refrigerant inlet temperature, $t_i$, of the evaporator is greater than the difference between the ambient temperature $t_a$ and the predetermined temperature $t_p$.

9. The method of claim 8, further comprising activating a heating element at the evaporator of the water heater appliance if the difference between the ambient temperature $t_a$ and the predetermined temperature $t_p$ is greater than the refrigerant outlet temperature $t_o$ of the evaporator at said step of determining or the difference between the ambient temperature $t_a$ and the predetermined temperature $t_p$ is greater than the refrigerant inlet temperature $t_i$ of the evaporator at said step of establishing.

10. The method of claim 8, wherein the predetermined temperature is about two and one-half degrees Fahrenheit.

11. The method of claim 7, wherein said step of terminating is performed at least ten minutes after said step of deactivating.

12. A water heater appliance, comprising:

a tank defining an interior volume;

a sealed system comprising a compressor, a condenser and an evaporator, the compressor operable to compress refrigerant, the condenser in fluid communication with the compressor such that refrigerant from the compressor is received by the condenser, the condenser thermally coupled to the tank in order to heat water within the interior volume of the tank with energy from the refrigerant;

a fan positioned adjacent the evaporator of the sealed system, the fan configured for selectively directing a flow of air across the evaporator of the sealed system;

an ambient temperature sensor configured for measuring an ambient temperature, $t_a$;

an outlet temperature sensor positioned adjacent an outlet of the evaporator and configured for measuring a refrigerant outlet temperature, $t_o$, of the evaporator;

a controller in operative communication with the compressor and the fan, the controller configured for establishing that the evaporator of the water heater appliance is frosted over by:

comparing the ambient temperature $t_a$ to a threshold temperature, $t_t$; and determining whether a difference between the ambient temperature $t_a$ and a reference temperature, $t_r$, is less than the refrigerant outlet temperature $t_o$, the reference temperature $t_r$ being adjustable based on the ambient temperature $t_a$;

initiating a defrost cycle;

deactivating the compressor of the sealed system during the defrost cycle; and operating the fan during the defrost cycle in order to direct the flow of air across the evaporator of the sealed system.

13. The water heater appliance of claim 12, wherein the sealed system further comprises a throttling valve configured for regulating a flow of refrigerant through the sealed system, the controller in operative communication with the throttling valve and further configured for opening the throttling valve after said step of deactivating.

14. The water heater appliance of claim 13, wherein the throttling valve is adjusted to a fully open position at said step of opening.

15. The water heater appliance of claim 12, further comprising a heating element positioned at the evaporator of the sealed system, the controller in operative communication with the heating element, the controller further configured for activating the heating element if a difference between an ambient temperature, $t_a$, at the water heater appliance and a predetermined temperature, $t_p$, is greater than a refrigerant outlet temperature, $t_o$, at the evaporator or the difference between the ambient temperature $t_a$ and the predetermined temperature $t_p$ is greater than a refrigerant inlet temperature, $t_i$, of the evaporator.

* * * * *